US005916854A

United States Patent [19]

Inaya et al.

[11] Patent Number: 5,916,854

[45] Date of Patent: Jun. 29, 1999

[54] BIODEGRADABLE LUBRICATING BASE OIL, LUBRICATING OIL COMPOSITION CONTAINING THE SAME AND THE USE THEREOF

[75] Inventors: Shuichi Inaya; Hiroki Sawada; Yuichiro Kobayashi; Toshiya Hagihara, all of Wakayama, Japan

[73] Assignee: Kao Corporation, Tokyo, Japan

[21] Appl. No.: 08/875,899

[22] PCT Filed: Feb. 13, 1996

[86] PCT No.: PCT/JP96/00320

§ 371 Date: Aug. 7, 1997

§ 102(e) Date: Aug. 7, 1997

[87] PCT Pub. No.: WO96/25474

PCT Pub. Date: Aug. 22, 1996

[30] Foreign Application Priority Data

Feb. 14, 1995 [JP] Japan ..... 7-050495
Apr. 28, 1995 [JP] Japan ..... 7-129766

[51] Int. Cl.[6] ..... C10M 101/04; C10M 111/00; C10M 109/02

[52] U.S. Cl. ..... 508/452; 508/455; 508/485; 508/488; 508/491; 508/492; 554/30; 554/124

[58] Field of Search ..... 508/452, 455, 508/485, 488, 492, 491; 554/30, 124

[56] References Cited

FOREIGN PATENT DOCUMENTS

A20247509 12/1987 European Pat. Off. .
312523 5/1929 United Kingdom .
1047253 11/1966 United Kingdom .
1050497 12/1966 United Kingdom .
1099777 1/1968 United Kingdom .
WO9602659 1/1995 WIPO .

OTHER PUBLICATIONS

Japanese Abstract: JP–A–1230697, Date Sep. 14, 1989.

Translation of PCT WO 95/02659 (pp. 1–13) Our Ref.: ml/ss/dp, Base Oil Made From Triglycerides For Use In Hydraulic Fluids no date.

*Primary Examiner*—Margaret Medley
*Attorney, Agent, or Firm*—Birch, Stewart, Kolasch & Birch, LLP

[57] ABSTRACT

A biodegradable lubricating base oil obtained by carrying out an addition reaction of an alkylene oxide and a transesterification in a mixture of fats and oils, a polyhydric alcohol or an aliphatic carboxylic acid, and an alkylene oxide, the mixture containing 5 to 150 mol of the alkylene oxide to 1 mol of the fats and oils; a biodegradable lubricating base oil obtained by carrying out esterification of all or part of the hydroxyl group in the above fats and oils derivative using an aliphatic carboxylic acid or ester derivative thereof. Further, a biodegradable lubricating oil composition containing the biodegradable lubricating base oil and the use thereof are also described.

10 Claims, No Drawings

BIODEGRADABLE LUBRICATING BASE OIL, LUBRICATING OIL COMPOSITION CONTAINING THE SAME AND THE USE THEREOF

This application is a 371 of PCT/JP96/00320 filed on Feb. 13, 1996, now WO96/25474.

TECHNICAL FIELD

The present invention relates to a highly biodegradable lubricating base oil and a lubricating oil composition containing the same. Specifically, the invention relates to a highly biodegradable lubricating base oil and a highly biodegradable lubricating oil composition containing the same which are free from concern about environmental pollution even though used in a setting where their contaminating rivers, ground-water, soil, the ocean, etc. is highly possible.

BACKGROUND ART

Most of the existing lubricating oil compositions, such as hydraulic oils for construction equipment, grease oils, chain saw oils used for tree cutting, and two cycle engine oils for leisure boats, contain mineral oils as a main component. In the above uses, scattering and leakage of oil cannot be avoided, resulting in contamination of rivers, ground-water, soil, the ocean, etc. Since the biodegradability of conventional lubricating oil compositions containing mineral oils as a main component are low, contamination of environment with such conventional lubricating oil compositions has recently become a more and more serious problem.

In order to solve the above problem of environmental pollution, there have been reports on lubricating oil compositions of which biodegradability is improved by using natural fats and oils, such as rapeseed oil, as a main component. For example, Japanese Patent Laid-Open No. 5-230490 discloses a biodegradable chain oil comprising 80 to 98% by weight vegetable oils, such as rapeseed oil, soybean oil, sesame oil and castor oil, and 2 to 20% by weight additives. Japanese Patent Unexamined No. 5-503949 discloses a hydraulic oil prepared by blending purified rapeseed oil and/or soybean oil as main components with specific oxidation inhibitors and ester components.

However, lubricating oil compositions containing natural fats and oils as a main component present a problem of thermal oxidation instability because natural fats and oils have many unsaturated bonds and are liable to oxidative degradation.

WO95/02659 discloses a highly biodegradable base oil for hydraulic oil, the main component of which being a compound prepared by esterifying an addition product of 0.5 to 3 mol of ethylene oxide and/or propylene oxide to 1 mol of glycerol with a saturated or unsaturated fatty acid having 6 to 24 carbon atoms, or a compound prepared by intramolecularly adding 0.5 to 3 mol of ethylene oxide and/or propylene oxide to 1 mol of natural fats and oils. However, when the amount of ethylene oxide and/or propylene oxide added to 1 mol of glycerol is in the range of from 0.5 to 3 mol, it is necessary to increase the number of unsaturated bonds in the resulting compound to meet the fluidity requirements of hydraulic oils at low temperatures. Thus, the compound of this prior art does not solve the problem with respect to thermal oxidation stability to be improved in the present invention.

Japanese Patent Laid-Open No. 1-230697 discloses a metal working lubricant which comprises, as an essential component, an addition product of an alkylene oxide to a mixture containing natural fats and oils and a trihydric or higher polyhydric alcohol, in which 10 to 100 mol of alkylene oxide is added to 1 mol of natural fats and oils. The object of the lubricant of this prior art is to eliminate the drawbacks of emulsion-type lubricants in the field of metalworking technology by making natural fats and oils of triglyceride structure soluble in water without impairing their lubricity. Therefore, there is no mention about biodegradability of the lubricant. Unlike the above-mentioned hydraulic oil, chain saw oil and two cycle engine oil, this prior art lubricant is used in a setting where its biodegradability has no significance in terms of environmental protection.

As lubricating oils for refrigerating machines using fluorocarbon as a refrigerant, Japanese Patent Laid-Open No. 4-328197 discloses a lubricating oil for fluorocarbon refrigerant having, as a main component, a compound obtained by esterifying the terminal hydroxyl groups of a glycerol type polyalkylene polyol with an aliphatic monocarboxyl compound. In addition, Japanese Patent Laid-Open No. 2-276881 discloses a composition for refrigerating machines using tetrafluoroethane refrigerant, the composition being obtained by acylating all or part of the terminal hydroxyl groups of a polyalkylene polyether of monohydric, dihydric or trihydric alcohols.

However, the above compounds used as lubricating oils for refrigerating machines have been developed focusing on the compatibility with fluorocarbon refrigerants, because the compounds are used in the atmosphere of fluorocarbon.

In order to prevent environmental pollution, hydraulic oils and grease oils, which are used in a setting where their leakage into natural environment cannot be avoided, are required to be highly biodegradable as well as highly stable to thermal oxidation. Hydraulic oils and grease oils which meet these requirements have yet to be known.

DISCLOSURE OF INVENTION

It is an object of the present invention to provide a lubricating base oil with high biodegradability and high stability to thermal oxidation and a lubricating oil composition containing the same.

As a result of intensive studies that the present inventors made with respect to the above object, it was found that a lubricating base oil containing a particular derivative obtained from fats and oils materials shows desired biodegradability and desired stability to thermal oxidation. Based on this finding, the inventors have completed the present invention.

The present invention is directed to a biodegradable lubricating base oil as defined in the independent patent claims 1, 2 and 10. Preferred features thereof are described in the sub-claims. Furthermore, the invention is directed to a biodegradable lubricating oil composition comprising said lubricating base oil. Finally, this invention is also directed to the use of said biodegradable lubricating oil composition as a lubricating oil, a hydraulic oil, a grease oil, a chain sew oil, a two cycle or a four cycle engine oil or a gear oil.

BEST MODE FOR CARRYING OUT THE INVENTION

The lubricating base oil of the present invention is a base oil usable in lubricating oil compositions which are required to be highly biodegradable in order to prevent environmental pollution. More specifically, the typical uses of the lubricating base oil of the present invention include uses as hydraulic oils, grease oils, chain sew oils, and two cycle engine oils. Also, the base oil of the present invention is used for four cycle engine oils and gear oils. Among the above uses, the lubricating base oils of the present invention are particularly suitable as hydraulic oils and grease oils, because hydraulic oils and grease oils are used in construction equipment, the setting where the environmental pollution with these oils may become a serious problem, and required to be stable to thermal oxidation. That is, the oils of the present invention can benefit in any fields where scattering and leakage of lubricating oils has recently become a problem of unavoidable contamination of rivers, ground-water, soil, and the ocean.

In the present specification, the property of being decomposed by microorganisms is referred to as biodegradability. Therefore, biodegradable lubricating base oils and lubricating oil compositions in the present specification mean lubricating base oils and lubricating oil compositions prepared by using a compound which can be decomposed by microorganisms.

The lubricating base oils of the present invention are roughly divided into 2 embodiments, according to the type of the starting materials for the production. Specifically, the first embodiment of the present invention is a biodegradable lubricating base oil comprising a fats and oils derivative obtainable by carrying out an addition reaction of an alkylene oxide and a transesterification in a mixture of fats and oils, a polyhydric alcohol, and an alkylene oxide, the mixture containing 5 to 150 mol of the alkylene oxide to 1 mol of the fats and oils. The second embodiment of the present invention is a biodegradable lubricating base oil comprising a fats and oils derivative obtainable by carrying out an addition reaction of an alkylene oxide and a transesterification in a mixture of fats and oils, an aliphatic carboxylic acid, and an alkylene oxide.

In the following description, statements in which there is no mention about which embodiment is concerned are applicable to both the first and the second embodiments.

In the present invention, "fats and oils" means a composition containing glycerol esters of fatty acids as a main component, encompassing natural fats and oils, synthetic fats and oils, and hydrogenated fats and oils.

Examples of the natural fats and oils include vegetable oils, such as coconut oil, palm oil, palm kernel oil, olive oil, soybean oil, rapeseed oil, cotton seed oil, linseed oil, sunflower oil, safflower oil, corn oil sesame oil, and castor oil; animal oils, such as tallow, lard, and bone oil; and fish oils, such as sardine oil, mackerel oil, shark liver oil, and recovered oils obtainable in a purification process of the above fats and oils.

Examples of the synthetic fats and oils include glycerol ester derivatives synthesized from saturated or unsaturated fatty acids and glycerol, which include monoglyceride, diglyceride and triglyceride.

The hydrogenated fats and oils are those obtained by reductively hydrogenating all or part of unsaturated bonds in the alkyl chains of the natural and synthetic fats and oils to saturated bonds.

In view of stability to thermal oxidation, fats and oils having a smaller number of unsaturated bonds are preferred among the above listed fats and oils. The iodine value of the fats and oils used in the present invention is preferably not higher than 120 (Ig/100 g), more preferably not higher than 60, and still more preferably not higher than 30. Specific examples include hydrogenated fats and oils, coconut oil and palm kernel oil.

In view of fluidity at low temperatures, fats and oils containing hydrocarbon groups having an average number of carbon atoms of not more than 16, preferably 8 to 16, such as coconut oil and palm kernel oil, are preferred.

The polyhydric alcohols used for the first embodiment of the present invention preferably have 2 to 60, more preferably 2 to 30 carbon atoms. The number of hydroxyl groups of the polyhydric alcohols used for the first embodiment of the present invention is preferably 2 to 20, more preferably 2 to 10, still more preferably 2 to 6.

Specifically, examples of the polyhydric alcohols include dihydric alcohols, such as neopentyl glycol, ethylene glycol, polyethylene glycol, propanediol, butanediol, and 1,6-hexanediol; trihydric alcohols, such as glycerol, trimethylolpropane, trimethylolethane, 1,2,4-butanetriol, and 1,2,6-hexanetriol; tetrahydric or higher polyhydric alcohols, such as diglycerol, triglycerol, tetraglycerol, polyglycerol, pentaerythritol, dipentaerythritol, ditrimethylolpropane, mannitol, and sorbitol.

Among the above polyhydric alcohols, a preference is give to glycerol, diglycerol, trimethylolpropane, pentaerythritol, sorbitol, ditrimethylolpropane dipentaerythritol and ethylene glycol.

The aliphatic carboxylic acids used in the second embodiment of the present,invention include monocarboxylic acids, such as saturated, linear carboxylic acids, saturated, branched carboxylic acids, unsaturated, linear carboxylic acids and unsaturated, branched carboxylic acids; linear and branched dicarboxylic acids; and polycarboxylic acids obtained by polymerization of unsaturated carboxylic acids, such as dimer acids and trimer acids. Specific preferred examples are one or more kinds of aliphatic carboxylic acids selected from the group consisting of (i) linear monocarboxylic acids having 1 to 12 carbon atoms; (ii) branched monocarboxylic acids having 4 to 20 carbon atoms; (iii) linear and branched dicarboxylic acids having 4 to 20 carbon atoms; and (iv) polycarboxylic acids obtained by polymerization of unsaturated carboxylic acids having 3 to 18 carbon atoms.

Specific examples of the linear monocarboxylic acids having 1 to 12 carbon atoms include saturated, linear monocarboxylic acids, such as acetic acid, propionic acid, butyric acid, pentanoic acid, caproic acid, heptanoic acid, caprylic acid, nonanoic acid, capric acid, and lauric acid; and unsaturated, linear monocarboxylic acids, such as hexenoic acid, nonenoic acid, and decenoic acid, among which a preference is given to saturated, linear monocarboxylic acids in view of fluidity at low temperatures and stability to thermal oxidation. Particularly, saturated, linear monocarboxylic acids having 6 to 10 carbon atoms, such as caproic acid, caprylic acid, and capric acid, are preferred.

Specific examples of the branched monocarboxylic acids having 4 to 20 carbon atoms include saturated, branched monocarboxylic acids, such as isobutyric acid, 2-methylhexanoic acid, 2-ethylpentanoic acid, 3-methylhexanoic acid, 2-ethylhexanoic acid, 3,5,5-trimethylhexanoic acid and isostearic acid; and unsaturated, branched monocarboxylic acids, such as methacrylic acid, among which a preference is given to saturated, branched monocarboxylic acids in view of fluidity at low temperatures and stability to thermal oxidation. Particularly, saturated, branched monocarboxylic acids having 6 to 18 carbon atoms, such as 2-ethylhexanoic acid and isostearic acid, are more preferred.

Specific examples of linear and branched dicarboxylic acids having 4 to 20 carbon atoms include saturated dicarboxylic acids such as succinic acid and adipic acid, and unsaturated dicarboxylic acids such as maleic acid, fumaric acid, and alkenylsuccinic acid.

Specific examples of polycarboxylic acids obtained by polymerization of unsaturated carboxylic acids having 3 to 18 carbon atoms include dimer acid having 36 carbon atoms obtained by dimerization of oleic acid, and trimer acids having 54 carbon atoms obtained by trimerization of oleic acid. Among them, hydrogenated dimer acids having 36 carbon atoms obtained by hydrogenating unsaturated bonds are preferably used. The use of polycarboxylic acids obtained by polymerization of unsaturated carboxylic acids having less than 18 carbon atoms is especially preferred, because the fluidity at low temperatures and the viscosity are at the desired levels.

Among the above aliphatic carboxylic acids of (i) to (iv), a preference is given to (i) linear monocarboxylic acids having 1 to 12 carbon atoms in view of biodegradability, fluidity at low temperatures and stability to thermal oxidation.

Examples of the alkylene oxides used in the present invention include ethylene oxide, propylene oxide, and butylene oxide, with a preference given to ethylene oxide in view of biodegradability, to propylene oxide in view of fluidity at low temperatures, and to propylene oxide and butylene oxide in view of compatibility with other oil soluble additives and lubricating base oils. One or more kinds of alkylene oxides can be used.

Here, fluidity at low temperatures means fluidity at 0° C. or below.

When two or more kinds of alkylene oxides are used, the addition reaction (polymerization) of the alkylene oxides may be at random or in block. In view of fluidity at low temperatures, addition reaction in block where addition of ethylene oxide is followed by addition of propylene oxide is preferred.

The higher the molar number of alkylene oxide used, the lower the biodegradability; the lower the molar number of alkylene oxide used, the lower the fluidity at low temperatures. Therefore, the amount of the alkylene oxide used in the reaction is 5 to 150 mol to 1 mol of fats and oils (i.e., 1 mol of glycerine portion of fats and oils), preferably 5 to 90 mol, more preferably 5 to 50 mol, and still more preferably 9 to 30 mol.

Also, fats and oils derivatives obtained by using ethylene oxide has better biodegradability and poorer fluidity at low temperatures than fats and oils derivatives obtained using propylene oxide. Examples of preferred compositions include:

(1) Ethylene oxide accounts for 40 to 100 mol %, preferably 40 to 90 mol % of the alkylene oxide; propylene oxide, 0 to 60 mol %, preferably 10 to 60 mol % of the alkylene oxide; and molar addition number of the alkylene oxide is 9 to 90 mol for 1 mol of fats and oils, and (2) Ethylene oxide accounts for 0 to 40 mol %, preferably 10 to 40 mol % of the alkylene oxide; propylene oxide, 60 to 100 mol %, preferably 60 to 90 mol % of the alkylene oxide; and molar addition number of the alkylene oxide is 5 to 30 mol to 1 mol of fats and oils. In view of biodegradability and economy, it is more preferable for the lubricating base oil of (1) or (2) to be prepared using only ethylene oxide and/or propylene oxide as alkylene oxide.

During the reaction, a catalyst, such as an alkaline substance (sodium hydroxide, potassium hydroxide, sodium methoxide, etc.) and a fatty acid soap, may be added to the mixture of fats and oils and the polyhydric alcohol. Then, to the mixture, an alkylene oxide may further be added and allowed to react at a temperature of from 50 to 200° C. and a pressure of from 1 to 5 kg/cm$^2$ to give the fats and oils derivatives of the first embodiment of the present invention. When an alkaline catalyst is used, the reaction mixture may be neutralized with an appropriate acid or subjected to adsorption treatment with an adsorbent by an ordinary method.

The reaction product thus obtained (fats and oils derivatives) is not a single compound but it consists of a mixture containing various compounds represented by formulas (I) to (III). As the addition reaction of alkylene oxide to compounds such as polyhydric alcohol and intermediate products proceed, transesterification between these intermediate products and the esterified glycerol portion in fats and oils takes place to give various compounds in the reaction mixture.

By the addition of alkylene oxide to polyhydric alcohol and transesterification between the addition product and fats and oils, compounds having structures as represented by formula (I) can be obtained. When the polyhydric alcohol is glycerol, formulas (I) and (III) are identical.

$$R^1 — \left[ \begin{array}{l} —O—(AO)_{a1}—X_1 \\ —O—(AO)_{a2}—X_2 \\ \vdots \\ —O—(AO)_{an}—X_n \end{array} \right] \quad (I)$$

wherein $R^1$ represents a hydrocarbon residue left after taking out hydroxyl groups from a polyhydric alcohol; AO represents an alkylene oxide; n indicates the number of hydroxyl groups of a polyhydric alcohol; a1+a2+. . . an is in the range of 5 to 150; X1, X2, . . . Xn independently represent a hydrogen atom or an R'CO group (R' is an alkyl group derived from aliphatic carboxylic acids or fats and oils), at least one of X1, X2, . . . Xn being an R'CO group.

The transesterification product between the self-polymerized polymer of an alkylene oxide as one of the intermediate products and fats and oils have the structures represented by,formula (II):

$$Z—O—(AO)c—Z \quad (II)$$

wherein AO represents an alkylene oxide, c>1, Z represents a hydrogen atom or an R'CO group (R' is an alkyl group derived from aliphatic carboxylic acids or fats and oils), at least one of Zs being an R'CO group.

The product obtained by the reactions which include: addition of an alkylene oxide to a free hydroxyl group of glycerol derivatives produced by transesterification between fats and oils and an addition product of an alkylene oxide to a polyhydric alcohol; and transesterification between the glycerol derivatives with alkylene oxide addition and other compounds present in the resulting mixture has the structure represented by formula (III):

(III)

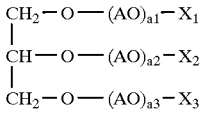

wherein AO represents an alkylene oxide; a1, a2, and a3 independently represent 0 or a positive integer, a1+a2+a3 being 5 to 150; $X_1$, $X_2$, and $X_3$ independently represent a hydrogen atom or a R'CO group (R' is an alkyl group derived from aliphatic carboxylic acids or fats and oils), at least one of $X_1$, $X_2$, and $X_3$ being a R'CO group.

The amount of the polyhydric alcohol used in the reaction is preferably 0.01 to 20 mol, more preferably 0.1 to 10 mol to 1 mol of glycerol portion of the fats and oils used.

It is also possible that one or more aliphatic carboxylic acids or esters thereof are present in the reaction process of the first embodiment to control kinematic viscosity and fluidity at low temperatures. Examples of the aliphatic carboxylic acids or esters thereof include linear monocarboxylic acids, such as hexanoic acid, heptanoic acid, octanoic acid, nonanoic acid, decanoic acid, lauric acid, myristic acid, and palmitic acid, and esters thereof: branched monocarboxylic acids, such as 2-methylhexanoic acid, 2-ethylpentanoic acid, 3-methylhexanoic acid, 2-ethylhexanoic acid, and 3,5,5-trimethylhexanoic acid, and esters thereof; and dicarboxylic acids, such as succinic acid, malonic acid, glutaric acid, and adipic acid, and esters thereof; polycarboxylic acids obtained by polymerization of unsaturated carboxylic acids, such as a dimer acids of 36 carbon atoms obtained by dimerization of oleic acid and a trimer acid of 54 carbon atoms obtained by trimerization of oleic acid, and esters thereof.

The fats and oils derivatives in the second embodiment of the present invention are prepared by carrying out an addition reaction of alkylene oxide and a transesterification in a mixture of fats and oils, an aliphatic carboxylic acid and an alkylene oxide. A catalyst, such as an alkaline substance (sodium hydroxide, potassium hydroxide, sodium methoxide, etc.) and fatty acid soap, may be added to the mixture of fats and oils and the aliphatic carboxylic acid. To the mixture, an alkylene oxide may be further added and allowed to react at a temperature of from 50 to 200° C. and a pressure of from 1 to 5 kg/cm$^2$ to give the fats and oils derivatives of the second embodiment of the present invention. When an alkaline catalyst is used, the reaction mixture may be neutralized with an appropriate acid or subjected to adsorption treatment with an adsorbent by a conventional method.

The reaction product thus obtained (fats and oils derivatives) is not a single component, but it consists of a mixture of various components represented by formulas (IV), (V) and (III). As the addition reaction of an alkylene oxide to compounds such as an aliphatic carboxylic acid and intermediate products proceed, transesterification between these intermediate products and the esterified glycerol portion in fats and oils takes place to give various compounds in the reaction mixture.

By the addition of alkylene oxide to aliphatic carboxylic acid and transesterification between the addition product and fats and oils, compounds having structures as represented by formula (IV) can be obtained.

(IV)

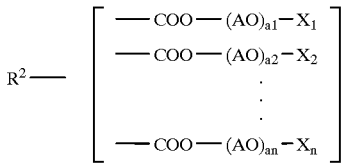

wherein $R^2$ represents a hydrocarbon residue left after taking out carboxylic groups from aliphatic carboxylic acid; AO represents an alkylene oxide; n indicates the number of carboxylic groups of an aliphatic carboxylic acid; a1+a2+ . . . an is preferably in the range of 5 to 150; X1, X2, . . . Xn independently represent a hydrogen atom or an R'CO group (R' is an alkyl group derived from aliphatic carboxylic acids or fats and oils), at least one of X1, X2, . . . Xn being an R'CO group.

The transesterification product between the self-polymerized polymer of an alkylene oxide as one of the intermediate products and fats and oils have the structures represented by formula (V):

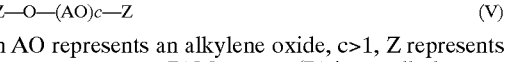

(V)

wherein AO represents an alkylene oxide, c>1, Z represents a hydrogen atom or an R'CO group (R' is an alkyl group derived from aliphatic carboxylic acids or fats and oils), at least one of Zs being an R'CO group.

Formula (III) shows the structure of the fats and oils derivatives formed in the reaction mixture as a result of the reactions which include: addition of an alkylene oxide to a free hydroxyl group of glycerol derivatives produced by transesterification between the fats and oils and an addition product of an alkylene oxide to an aliphatic carboxylic acid; and transesterification between the glycerol derivatives with alkylene oxide addition and other compounds present in the resulting mixture.

(III)

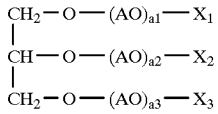

wherein AO represents an alkylene oxide; a1, a2, and a3 independently represent a numeral of 0 or a positive integer, a1+a2+a3 being 1 to 200 mol, preferably 5 to 150 mol; $X_1$, $X_2$ and $X_3$ independently represent a hydrogen atom or an R'CO group (R' is an alkyl group derived from the aliphatic carboxylic acid or the fats and oils), at least one of $X_1$, $X_2$ and $X_3$ being an R'CO group.

The amount of the aliphatic carboxylic acid used in the reaction is preferably 0.01 to 20 mol, more preferably 0.1 to 10 mol to 1 mol of glycerol portion of the fats and oils used.

The lubricating base oils of the present invention may be those with improved compatibility with mineral oils, other hydrocarbon base oils such as poly-α-olefin, or oil soluble additives, the improvement being achieved by esterifying all or part of hydroxyl groups of the lubricating base oil prepared by the above process (fats and oils derivatives) with an aliphatic carboxylic acid or the ester derivative thereof. The hydroxyl value of the esterified fats and oils derivatives is preferably not higher than 50 (mgKOH/g), more preferably not higher than 30 (mgKOH/g).

The aliphatic carboxylic acid or the ester derivative thereof is preferably at least one kind of aliphatic carboxylic acid selected from the group consisting of (i) saturated, linear carboxylic acids having 1 to 18 carbon atoms, and (ii) saturated, branched carboxylic acids having 4 to 20 carbon atoms, or the ester derivatives thereof. The ester derivatives of aliphatic carboxylic acids are preferably those formed with lower alcohols having 1 to 4 carbon atoms, such as methanol, ethanol, propanol, isopropanol, butanol, and isobutanol, with a preference given to methanol.

Specific examples of the linear, saturated carboxylic acids having 1 to 18 carbon atoms include acetic acid, propionic acid, butyric acid, pentanoic acid, caproic acid, heptanoic acid, caprylic acid, nonanoic acid, capric acid, lauric acid, myristic acid, palmitic acid, and stearic acid, among which a preference is given to saturated, linear carboxylic acids having 6 to 12 carbon atoms, such as caproic acid, caprylic acid, capric acid, and lauric acid.

Specific examples of saturated, branched carboxylic acids having 4 to 20 carbon atoms include isobutyric acid, 2-methylhexanoic acid, 2-ethylpentanoic acid, 3-methylhexanoic acid, 2-ethylhexanoic acid, 3,5,5-trimethylhexanoic acid, and isostearic acid, among which a preference is given to saturated, branched carboxylic acids having 6 to 18 carbon atoms, such as 2-ethylhexanoic acid, and isostearic acid.

Specifically, the above esterification of fats and oils derivatives may be carried out by the steps of adding, for example, a methyl ester of an aliphatic carboxylic acid to the fats and oils derivatives, and heating at a temperature of from 80 to 150° C. while recovering the methanol formed. When the esterification is carried out using an aliphatic carboxylic acid, an aliphatic carboxylic acid is added to the fats and oils derivatives and the mixture is heated at a temperature of from 150 to 230° C. for dehydration.

The lubricating oil composition of the present invention, which comprises the fats and oils derivatives mentioned above, shows a better stability to thermal oxidation than those using rapeseed oil. The stability is further improved by decreasing the iodine value of the fats and oils derivatives to 50 or lower, preferably to 20 or lower, more preferably to 10 or lower. This is because as the number of unsaturated bond of the fats and oils derivatives decreases, the fats and oils derivatives become less prone to oxidative degradation due to heating, thereby acquiring an improved stability to thermal oxidation.

In view of compatibility with hydrocarbon base oils such as mineral oils and poly-α-olefin, and other oil-soluble additives, the hydroxyl value of the fats and oils derivatives of the present invention is preferably not higher than 50 (mgKOH/g), more preferably not higher than 30. The compatibility may also be influenced by the type of alkylene oxide used. For example, propylene oxide and butylene oxide improve the compatibility.

In view of preventing metal corrosion, the acid value of the fats and oils derivatives of the present invention is preferably not more than 5 (mgKOH/g), more preferably not more than 3, still more preferably not more than 1.

When considering the setting where the lubricating base oils of the present invention are used, it is preferred that the kinematic viscosity at 100° C. (determined according to JIS K-2283) is preferably in the range of from 1 to 100 $mm^2/s$, more preferably in the range of from 2 to 50 $mm^2/s$, still more preferably in the range of from 3 to 30 $mm^2/s$. Furthermore, the pour point (determined according to JIS K-2269) is preferably not higher than 0° C., more preferably not higher than −10° C., still more preferably not higher than −20° C.

The lubricating oil composition of the present invention can be used as a lubricating oil composition of which biodegradability is required to be high in view of prevention of environmental pollution and comprises the above mentioned fats and oils derivatives in an amount of 50% by weight or more, preferably 80% by weight or more.

As long as a desired biodegradability is achieved, the lubricating oil composition of the present invention may further contain one or more kinds of lubricating base oils selected from the group consisting of (i) mineral oils (e.g. naphtene oil and paraffin oil), (ii) natural or synthetic fats and oils, (iii) poly-α-olefin, (iv) polybuthene, and (v) polyol esters formed from linear or branched fatty acids and polyhydric alcohols.

Further, in the lubricating oil composition of the present invention, for the purpose of improving its performance, various known additives may be used in an amount so as not to impair biodegradability of the resulting composition. Example of the additives include metallic detergents, such as basic calcium sulfonate, basic calcium phenate, and basic calcium salicylate; detergent dispersants, such as alkenyl succinimides, benzylamine, and polyalkenylamines; viscosity index improver, such as polymethacrylates and olefin copolymers; pour point depressants; antioxidants; anticorrosive agents; and defoaming agents. Specific examples are set forth in "Additives for Petroleum Products" by Toshio Sakurai (Saiwai Shobo). The above additives may be used singly or in combination of two or more of them. The amount of the above additives is not limited as long as the biodegradability of the resulting composition is not impaired, which is usually not more than 30 parts by weight, preferably not more than 15 parts by weight, based upon 100 parts by weight of the lubricating oil composition of the present invention.

The lubricating oil composition of the present invention is highly biodegradable and highly stable to thermal oxidation. These properties make the composition particularly suitable as hydraulic oil, grease oil, chain sew oil, and two cycle engine oil. It can also be used as four cycle engine oil and gear oil. Among the above applications, the lubricating base oil of the present invention is particularly suitable as hydraulic oils and gear oils which are used for construction equipment, the setting where there is a serious potential for the oils to contaminate the natural environment and the oils are required to be highly stable to thermal oxidation.

EXAMPLES

The present invention will be described in further detail by means of the following working examples, comparative examples, and test examples, without intending to restrict the scope of the present invention thereto.

Example 1

In a five-liter autoclave, 673 g (1 mol, iodine value 11) of coconut oil, 414 g (4.5 mol) of glycerol, and 1.7 g of potassium hydroxide were placed, and the contents were heated to a temperature of 150° C. under nitrogen stream. Next, 1320 g (30 mol) of ethylene oxide was gradually allowed to react with the above components under the conditions of a temperature of 150° C., and a pressure of 3.5 $kg/cm^2$. After the addition reaction of ethylene oxide, the reaction mixture was cooled to a temperature of 80° C., and an appropriate amount of acetic acid was added so as to neutralize the solution to pH 6. The obtained reaction product had an iodine value of 2.8 Ig/100 g and a kinematic viscosity at 100° C. of 10.2 $mm^2/s$.

Incidentally, the molar number of coconut oil was determined by the molecular weight calculated from the saponification value thereof, assuming that the composition of the coconut oil comprises 100% triglyceride. All of the molar numbers for various fats and oils used hereinbelow are also similarly determined. Kinematic viscosity was determined according to JIS K-2283. All the values of kinematic viscosity hereinbelow were also similarly determined.

Example 2

In a five-liter autoclave, 841 g (1 mol, iodine value 0.9) of hydrogenated palm oil, 514 g (2 mol) of palmitic acid, 230 g (2.5 mol) of glycerol and 1.7 g of potassium hydroxide were placed, and the contents were heated to a temperature of 150° C. under nitrogen stream. Next, 2200 g (50 mol) of ethylene oxide was gradually allowed to react with the above components under the conditions of a temperature of 150° C., and a pressure of 3.5 kg/cm$^2$. After the addition reaction of ethylene oxide, the reaction mixture was cooled to a temperature of 80° C., and an appropriate amount of acetic acid was added so as to neutralize the solution to pH 6. The obtained reaction product had an iodine value of 0.2 Ig/100 g and a kinematic viscosity at 100° C. of 15.7 mm$^2$/s.

Example 3

In a five-liter autoclave, 990 g (1 mol, iodine value 100) of rapeseed oil, 184 g (2 mol) of glycerol, and 1.7 g of potassium hydroxide were placed, and the contents were heated to a temperature of 150° C. under nitrogen stream. Next, 440 g (10 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and an appropriate amount of acetic acid was added so as to neutralize the solution to pH 6. The obtained reaction product had an iodine value of 61.3 Ig/100 g and a kinematic viscosity at 100° C. of 7.4 mm$^2$/s.

Example 4

In a five-liter autoclave, 886 g (1 mol, iodine value 102) of soybean oil, 46 g (0.5 mol) of glycerol, and 1.7 g of potassium hydroxide were placed, and the contents were heated to a temperature of 150° C. under nitrogen stream. Next, 880 g (20 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and an appropriate amount of acetic acid was added so as to neutralize the solution to pH 6. The obtained reaction product had an iodine value of 48.9 Ig/100 g and a kinematic viscosity at 100° C. of 16.3 mm$^2$/s.

Example 5

Eighty parts by weight of the reaction product obtained in Example 1 was blended with 20 parts by weight of a synthetic ester (a lubricating base oil consisting of an ester formed between a linear fatty acid of C8 to C18 and pentaerythritol).

Example 6

In a five-liter autoclave, 687 g (1 mol, iodine value 18) of palm kernel oil, 92 g (1 mol) of glycerol, and 1.1 g of potassium hydroxide were placed, and the contents were heated to a temperature of 150° C. under nitrogen stream. Next, 880 g (20 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 660S" manufactured by Kyowa Chemical Industries) was added to the mixture. After being stirred for 30 minutes, the mixture was subjected to filtration. The obtained reaction product had an iodine value of 7.5 Ig/100 g and a kinematic viscosity at 100° C. of 10.7 mm$^2$/s.

Example 7

In a five-liter autoclave, 673 g (1 mol, iodine value 11) of coconut oil, 134 g (0.5 mol) of trimethylolpropane, and 1.1 g of potassium hydroxide were placed, and the contents were heated to a temperature of 150° C. under nitrogen stream. Next, 1188 g (27 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 600S" manufactured by Kyowa Chemical Industries) was added to the mixture. After being stirred for 30 minutes, the mixture was subjected to filtration. The obtained reaction product had an iodine value of 3.8 Ig/100 g and a kinematic viscosity at 100° C. of 10.7 mm$^2$/s.

Example 8

In a five-liter autoclave, 673 g (1 mol, iodine value 11) of coconut oil, 62 g (1 mol) of ethylene glycol, and 1.1 g of potassium hydroxide were placed, and the contents were heated to a temperature of 150° C. under nitrogen stream. Next, 660 g (15 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 600S" manufactured by Kyowa Chemical Industries) was added to the mixture. After being stirred for 30 minutes, the mixture was subjected to filtration. The obtained reaction product had an iodine value of 5.3 Ig/100 g and a kinematic viscosity at 100° C. of 9.4 mm$^2$/s.

Example 9

In a five-liter autoclave, 673 g (1 mol, iodine value 11) of coconut oil, 288 g (2 mol) of 2-ethylhexanoic acid, and 1.1 g of potassium hydroxide were placed, and the contents were heated to a temperature of 150° C. under nitrogen stream. Next, 881 g (20 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 600S" manufactured by Kyowa Chemical Industries) was added to the mixture. After being stirred for 30 minutes, the mixture was subjected to filtration. The obtained reaction product had an iodine value of 3.0 Ig/100 g and a kinematic viscosity at 100° C. of 5.2 mm$^2$/s.

Example 10

In a five-liter autoclave, 1346 g (2 mol) of coconut oil, 55.2 g (0.6 mol) of glycerol, and 9 g of potassium hydroxide were placed, and the contents were heated to a temperature of 150° C. under nitrogen stream. Next, 1258 g (24 mol) of a mixture of ethylene oxide and propylene oxide (ethylene oxide: propylene oxide=40 mol %:60 mol %) was gradually allowed to react with the above components under the conditions of a temperature of 150° C. and a pressure of 3.5 kg/cm$^2$. After the addition reaction of ethylene oxide and propylene oxide, the reaction mixture was cooled to a temperature of 80° C., and 50 g of an adsorbent ("KYOWARD 600S" manufactured by Kyowa Chemical Industries) was added to the mixture. After being stirred for 30 minutes, the mixture was subjected to filtration. The obtained reaction product had an iodine value of 4.4 Ig/100 g and a kinematic viscosity at 100° C. of 9.2 mm$^2$/s Example 11

In a five-liter autoclave, 1346 g (2 mol) of coconut oil, 55.2 g (0.6 mol) of glycerol, and 9 g of potassium hydroxide were placed, and the contents were heated to a temperature of 150° C. under nitrogen stream. Next, 1856 g (32 mol) of propylene oxide was gradually allowed to react with the above components under the conditions of a temperature of 150° C. and a pressure of 3.5 kg/cm$^2$. After the addition reaction of propylene oxide, the reaction mixture was cooled to a temperature of 80° C., and 50 g of an adsorbent ("KYOWARD 600S" manufactured by Kyowa Chemical Industries) was added to the mixture. After being stirred for 30 minutes, the mixture was subjected to filtration. The obtained reaction product had an iodine value of 4.1 Ig/100 g and a kinematic viscosity at 100° C. of 10.2 mm$^2$/s.

Example 12

In a five-liter autoclave, 673 g (1 mol, iodine value 11) of coconut oil, 585 g (0.5 mol) of dimer acid of C36 (Empol 1008 manufactured by Henkel), and 2.8 g of potassium hydroxide were placed, and the contents were heated to a temperature of 150° C. under nitrogen stream. Next, 705 g (16 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 20 g of an adsorbent ("KYOWARD 600S" manufactured by Kyowa Chemical Industries) was added to the mixture. After being stirred for 30 minutes, the mixture was subjected to filtration. The obtained reaction product had an iodine value of 4.2 Ig/100 g and a kinematic viscosity at 100° C. of 19.1 mm$^2$/s.

Example 13

In a five-liter autoclave, 673 g (1 mol, iodine value 11) of coconut oil, 725 g (5 mol) of caprylic acid, and 1.1 g of potassium hydroxide were placed, and the contents were heated to a temperature of 150° C. under nitrogen stream. Next, 1410 g (32 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 600S" manufactured by Kyowa Chemical Industries) was added to the mixture. After being stirred for 30 minutes, the mixture was subjected to filtration. The obtained reaction product had an iodine value of 2.4 Ig/100 g and a kinematic viscosity at 100° C. of 8.6 mm$^2$/s.

Example 14

In a five-liter autoclave, 687 g (1 mol, iodine value 18) of palm oil, 288 g (2 mol) of 2-ethylhexanoic acid, and 1.1 g of potassium hydroxide were placed, and the contents were heated to a temperature of 150° C. under nitrogen stream. Next, 881 g (20 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C., and 9 g of an adsorbent ("KYOWARD 600S" manufactured by Kyowa Chemical Industries) was added to the mixture. After being stirred for 30 minutes, the mixture was subjected to filtration. The obtained reaction product had an iodine value of 4.3 Ig/100 g and a kinematic viscosity at 100° C. of 6.1 mm$^2$/s.

Example 15

In a five-liter autoclave, 673 g (1 mol) of coconut oil, 92 g (1 mol) of glycerol, and 1.7 g of potassium hydroxide were placed, and the contents were heated to a temperature of 150° C. under nitrogen stream. Next, 1056 g (24 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C.

Then, 660 g of coconut fatty acid methyl ester*1 (trade name: "EXCEPARL MC" manufactured by Kao Corporation) was added to the reaction mixture and the mixture was heated to 120° C. with gradual lowering of pressure to 10 Toor. The methanol formed as a by-product was successively recovered during the reaction.

*1: A mixture of esters having aliphatic carboxylic acids portion of C8 to C18.

After the reaction, the reaction mixture was cooled to 80° C., and 14 g of an adsorbent ("KYOWARD 600S" manufactured by Kyowa Chemical Industries) was added. After being stirred for 30 minutes, the mixture was subjected to filtration. The obtained reaction product had an iodine value of 3.5 Ig/100 g, an acid value of 0.4 mgKOH/g, a hydroxyl value of 18 mgKOH/g, and a kinetic viscosity at 100° C. of 10.2 mm$^2$/s.

Example 16

In a five-liter autoclave, 673 g (1 mol) of coconut oil, 134 g (0.5 mol) of trimethylolpropane, and 1.1 g of potassium hydroxide were placed, and the contents were heated to a temperature of 150° C. under nitrogen stream. Next, 396 g (9 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C.

Then, 330 g of coconut fatty acid methyl ester (trade name: "EXCEPARL MC" manufactured by Kao Corporation) was added and the mixture was heated to 120° C. with gradual lowering of pressure to 10 Toor. The methanol formed as a by-product was successively recovered during the reaction.

After the reaction, the reaction mixture was cooled to 80° C., and 9 g of an adsorbent ("KYOWARD 600S" manufactured by Kyowa Chemical Industries) was added. After being stirred for 30 minutes, the mixture was subjected to filtration. The obtained reaction product had an iodine value of 5.2 Ig/100 g, an acid value of 0.6 mgKOH/g, a hydroxyl value of 46 mgKOH/g, and a kinematic viscosity at 100° C. of 8.1 mm$^2$/s.

Example 17

In a five-liter autoclave, 687 g (1 mol, iodine value 18) of palm kernel oil, 46 g (0.5 mol) of glycerol, and 1.7 g of potassium hydroxide were placed, and the contents were heated to a temperature of 150° C. under nitrogen stream. Next, 594 g (13.5 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C. After 14 g of an adsorbent ("KYOWARD 600S," manufactured by Kyowa Chemical Industries) was added and stirred for 30 minutes, the mixture was subjected to filtration.

Then, 70 g of caprylic acid (trade name: "LUNAC 8-98" manufactured by Kao Corporation) was added to the reaction mixture, and the mixture was heated to 210° C. and allowed to react, followed by gradual lowering of pressure to 5 Torr. Then, aliphatic carboxylic acids unreacted were distilled off.

The obtained reaction product had an iodine value of 8.9 Ig/100 g, an acid value of 0.5 mgKOH/g, a hydroxyl value of 10 mgKOH/g, and a kinematic viscosity at 100° C. of 9.2 mm2/s.

Example 18

In a five-liter autoclave, 687 g (1 mol, iodine value 18) of palm kernel oil, 46 g (0.5 mol) of glycerol, and 1.7 g of potassium hydroxide were placed, and the contents were heated to a temperature of 150° C. under nitrogen stream. Next, 594 g (13.5 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C. After 14 g of an adsorbent ("KYOWARD 600S," Kyowa Chemical Industries) was added and stirred for 30 minutes, the mixture was subjected to filtration.

Then, 72 g of 2-ethylhexanoic acid was added to the reaction mixture, and the mixture was heated to 210° C. and allowed to react, followed by gradual lowering of pressure to 5 Torr. Then, aliphatic carboxylic acids unchanged were distilled off.

The obtained reaction product had an iodine value of 9.5 Ig/100 g, an acid value of 0.6 mgKOH/g, a hydroxyl value of 13 mgKOH/g, and a kinematic viscosity at 100° C. of 10.1 mm$^2$/s.

Example 19

In a five-liter autoclave, 1346 g (2 mol) of coconut oil, 55.2 g (0.6 mol) of glycerol, and 3 g of potassium hydroxide were placed, and the contents were heated to a temperature of 150° C. under nitrogen stream. Next, 1056 g (24 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C. After 24 g of an adsorbent ("KYOWARD 600S," Kyowa Chemical Industries) was added and stirred for 30 minutes, the mixture was subjected to filtration.

Example 20

In a five-liter autoclave, 1346 g (2 mol) of coconut oil, 55.8 g (0.9 mol) of ethylene glycol, and 9 g of potassium hydroxide were placed, and the contents were heated to a temperature of 120° C. under nitrogen stream. Next, 1713 g (31 mol) of a mixture of ethylene oxide and propylene oxide (ethylene oxide: propylene oxide=20 mol %:80 mol %) was gradually allowed to react with the above components under the conditions of a temperature of 120° C. and a pressure of 3.5 kg/cm$^2$. After the addition reaction of ethylene oxide and propylene oxide, the reaction mixture was cooled to a temperature of 80° C., and 50 g of an adsorbent ("KYOWARD 600S" manufactured by Kyowa Chemical Industries) was added to the mixture. After being stirred for 30 minutes, the mixture was subjected to filtration.

Example 21

In a five-liter autoclave, 673 g (1 mol) of coconut oil, 27.9 g (0.45 mol) of ethylene glycol, and 4.5 g of potassium hydroxide were placed, and the contents were heated to a temperature of 150° C. under nitrogen stream. Next, 138 g (3.1 mol) of ethylene oxide was gradually allowed to react with the above components under the conditions of a temperature of 150° C. and a pressure of 3.5 kg/cm$^2$. Thereafter, the reaction mixture was cooled to a temperature of 120° C., and 720 g (12.4 mol) of propylene oxide was allowed to react therewith. Subsequently, the reaction mixture was cooled to a temperature of 80° C., and 25 g of an adsorbent ("KYOWARD 600S" manufactured by Kyowa Chemical Industries) was added to the mixture. After being stirred for 30 minutes, the mixture was subjected to filtration.

The obtained reaction product had an iodine value of 7.0 Ig/100 g, an acid value of 0.6 mgKOH/g, a hydroxyl value of 62 mgKOH/g, and a kinematic viscosity at 100° C. of 9.2 mm$^2$/s.

Example 22

In a five-liter autoclave, 673 g (1 mol) of coconut oil, 27.9 g (0.45 mol) of ethylene glycol, and 4.5 g of potassium hydroxide were placed, and the contents were heated to a temperature of 120° C. under nitrogen stream. Next, 2155 g (39 mol) of a mixture of ethylene oxide and propylene oxide (ethylene oxide: propylene oxide=20% mol %:80 mol %) was gradually allowed to react with the above components under the conditions of a temperature of 120° C. and a pressure of 3.5 kg/cm$^2$. After the addition reaction of ethylene oxide and propylene oxide, the reaction mixture was cooled to a temperature of 80° C., and 25 g of an adsorbent ("KYOWARD 600S" manufactured by Kyowa Chemical Industries) was added to the mixture. After being stirred for 30 minutes, the mixture was subjected to filtration.

The obtained reaction product had an iodine value of 2.1 Ig/100 g, an acid value of 0.4 mgKOH/g, a hydroxyl value of 19 mgKOH/g, and a kinematic viscosity at 100° C. of 15.4 mm$^2$/s.

Example 23

In a five-liter autoclave, 1346 g (2 mol) of coconut oil, 55.2 g (0.6 mol) of glycerol, and 3 g of potassium hydroxide were placed, and the contents were heated to a temperature of 150° C. under nitrogen stream. Next, 660 g (15 mol) of ethylene oxide was gradually allowed to react with the above components under the conditions of a temperature of 150° C. and a pressure of 3.5 kg/cm$^2$. After the addition reaction of ethylene oxide, the reaction mixture was cooled to a temperature of 80° C. Thereafter, the reaction mixture was cooled to a temperature of 80° C., and 24 g of an adsorbent ("KYOWARD 600S" manufactured by Kyowa Chemical Industries) was added to the mixture. After being stirred for 30 minutes, the mixture was subjected to filtration.

The obtained reaction product had an iodine value of 5.7 Ig/100 g, an acid value of 0.5 mgKOH/g, a hydroxyl value of 54 mgKOH/g, and a kinematic viscosity at 100° C. of 8.2 mm$^2$/s.

[Structure Confirmation Test]

Data of infrared absorption spectrum (measured by infrared spectrophotometer "MODEL 270," manufactured by Hitachi, Ltd.) and proton nuclear magnetic resonance spectrum (measured by "AC200P," manufactured by Bluker) for each of fats and oils derivatives obtained in Examples 11 and 19 of the present invention were presented below. From these data, it was found that the fats and oils derivatives obtained in Examples 11 and 19 were compounds represented by the general formula (III).

Fats and Oils Derivative of Example 11

IR (NEAT, $cm^{-1}$) 3500 (O—H stretching), 2925, 2855 (C—H stretching), 1732 (C═O stretching), 1460 (C—H deformation), 1100 (C—O stretching) ps $^1H$ NMR($CDCl_3$, δppm):

a: 0.8–1.0 (multiplet, 9H)
b: 1.1–1.2 (multiplet, 42H)
c: 1.2–1.5 (multiplet, 50H)
d: 1.5–1.7 (multiplet, 6H)
e: 2.2–2.4 (triplet, 6H)
f: 3.1–4.0 (multiplet, 53H)
g: 5.0–5.2 (multiplet, 3H)

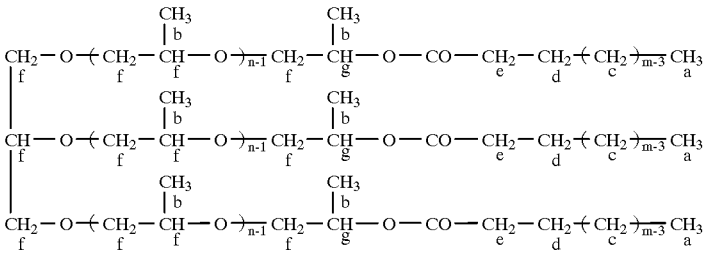

In the above formula, m is an average number of carbon atoms in alkyls, and n is an average additional molar number of an alkylene oxide.

Fats and Oils Derivative of Example 19

IR (NEAT, $cm^{-1}$) 3500 (O—H stretching), 2925, 2855 (C—H stretching), 1738 (C═O stretching), 1460 (C—H deformation), 1120 (C—O stretching)

$^1H$ NMR($CDCl_3$, δppm):

a: 0.8–1.0 (multiplet, 9H)
b: 1.1–1.5 (multiplet, 54H)
c: 1.5–1.7 (multiplet, 6H)
d: 2.2–2.4 (multiplet, 6H)
e: 3.4–3.9 (triplet, 52H)
f: 4.2–4.3 (multiplet, 6H)

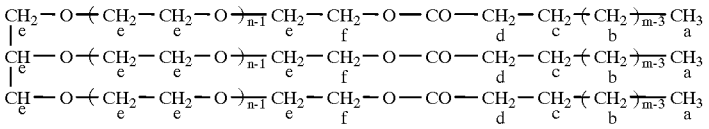

In the above formula, m is an average number of carbon atoms in alkyls, and n is an average additional molar number of an alkylene oxide.

Comparative Examples 1 and 2

In order to evaluate the effect of the above examples by comparison, commercially available paraffin mineral oil (viscosity classification: SAE10W) as Comparative Example 1 and commercially available rapeseed oil (iodine value: 118.3 Ig/100 g) as Comparative Example 2 were used.

Comparative Example 3

In a five-liter autoclave, 1346 g (2 mol) of coconut oil, 55.2 g (0.6 mol) of glycerol, and 3 g of potassium hydroxide were placed, and the contents were heated to a temperature of 150° C. under nitrogen stream. Next, 264 g (6 mol) of ethylene oxide was gradually allowed to react with the above components under the conditions of a temperature of 150° C. and a pressure of 3.5 $kg/cm^2$. After the addition reaction of ethylene oxide, the reaction mixture was cooled to a temperature of 80° C. Thereafter, the reaction mixture was cooled to a temperature of 80° C., and 24 g of an adsorbent ("KYOWARD 600S" manufactured by Kyowa Chemical Industries) was added to the mixture. After being stirred for 30 minutes, the mixture was subjected to filtration.

The obtained reaction product had an iodine value of 7.0 Ig/100 g, an acid value of 0.4 mgKOH/g, a hydroxyl value of 64 mgKOH/g, and a kinematic viscosity at 100° C. of 7.6 $mm^2/s$.

Comparative Example 4

In a five-liter autoclave, 1980 g (2 mol) of rapeseed oil, 55.2 g (0.6 mol) of glycerol, and 6 g of potassium hydroxide were placed, and the contents were heated to a temperature of 120° C. under nitrogen stream. Next, 349 g (6 mol) of propylene oxide was gradually allowed to react with the above components under the conditions of a temperature of 120° C. and a pressure of 3.5 $kg/cm^2$. After the addition reaction of propylene oxide, the reaction mixture was cooled to a temperature of 80° C., and 48 g of an adsorbent ("KYOWARD 600S" manufactured by Kyowa Chemical Industries) was added to the mixture. After being stirred for 30 minutes, the mixture was subjected to filtration.

The obtained reaction product had an iodine value of 155 Ig/100 g, an acid value of 0.6 mgKOH/g, a hydroxyl value of 45 mgKOH/g, and a kinematic viscosity at 100° C. of 8.5 $mm^2/s$ Test Example 1

[Biodegradability Test]

Biodegradability of the examples and comparative examples mentioned above was tested according to OECD 301B test or CEC-L33-A-93 test, and the results are shown in Table 1.

According to the 301B test developed by OECD (Organization for Economic Cooperation and Development), a compound is judged to be biodegradable when the amount of $CO_2$ gas generated by bacterial decomposition (test period: 28 days) accounts for 60% or higher of the total theoretical amount of $CO_2$ gas calculated based upon the amount of carbon in a sample.

All of the lubricating base oils of Examples 1 to 9, and 12 to 18 were judged to be biodegradable.

The test of CEC-L33-A-93 is developed by CEC (Coordinating European Council), which is used for testing the biodegradability of engine oils for two stroke cycle outboard motors. This test is also widely used to evaluated the biodegradability of water-insoluble lubricating oils such as hydraulic oils and grease. In this test, a sample and a source of microorganisms are cultured with shaking at 25° C. for 21 days, and extracted with carbon tetrachloride. The infrared absorption spectrum of the extract is determined and the absorption intensity due to the methylene groups in the sample is quantified to calculate the biodegradability rate (%) of the sample. Those giving 67% or higher biodegradability rate are acceptable in this test.

All the lubricating base oils of Examples 10, 11, 19–23 show a biodegradability of not lower than 67%.

TABLE 1

| | | Compositions | Biodegrad-ability (%) (OECD 301B) | Biodegrad-ability (%) (CEC L33) | Kinematic viscosity at 100° C. | Iodine value | Hydroxyl value | Acid value | Pour point (° C.) |
|---|---|---|---|---|---|---|---|---|---|
| Examples | 1 | Coconut oil/glycerol(4.5)/ethylene oxide(30) | 70 | | 10.2 | 2.8 | 224 | 0.3 | −5.0 |
| | 2 | Hardened palm oil/glycerol(2.5)/palmitic acid(2)/ethylene oxide (50) | 62 | — | 15.7 | 0.2 | 168 | 0.4 | 10.0 |
| | 3 | Rapeseed oil/glycerol(2)/ethylene oxide(10) | 72 | — | 7.4 | 61.3 | 220 | 0.5 | −22.5 |
| | 4 | Soybean oil/glycerol(0.5)/ethylene oxide(20) | 76 | — | 16.3 | 48.9 | 48 | 0.2 | −22.5 |
| | 5 | Ex.1(80% by weight) + Synthetic ester (20X by weight) | 75 | — | — | — | — | — | — |
| | 6 | Palm kernel oil/glycerol(1)/ethylene · oxide (20) | 70 | — | 10.7 | 7.5 | 120 | 0.05 | −12.5 |
| | 7 | Coconut oil/trimethylolpropane(0.5)/ethylene oxide(27) | 74 | — | 10.7 | 3.8 | 48 | 0.2 | −2.5 |
| | 8 | Coconut oil/ethylene glycol(1)/ethylene oxide(15) | 72 | — | 9.4 | 5.3 | 75 | 0.08 | −7.5 |
| | 9 | Coconut oil/2-ethylhexanoic acid(2)/ethylene oxide(20) | 68 | — | 5.2 | 3.0 | 80 | 0.07 | −12.5 |
| | 10 | Coconut oil/glycerol(0.3)/(ethylene · oxide propylene oxide random#(12) | — | 98 | 9.2 | 4.4 | 49 | 0.5 | −15.0 |
| | 11 | Coconut oil/glycerol(0.3)/propylene oxide(16) | — | 92 | 10. 2 | 4.1 | 46 | 0.7 | −32.5 |
| Examples | 12 | Coconut oil/C36 dimeric acid(0.5)/ethyleneoxide (16) | 62 | — | 19.1 | 4.2 | 41 | 0.4 | −7.5 |
| | 13 | Coconut oil/caprylic acid(5)/ethylene oxide(32) | 74 | — | 8.6 | 2.4 | 98 | 0.2 | −10.0 |
| | 14 | Palm kernel oil/2-ethylhexanoic acid(2)/ethylene oxide (20) | 70 | — | 6.1 | 4.3 | 80 | 0.1 | −15.0 |
| | 15 | Coconut oil/glycerol(1)/ethylene oxide(24) + Methyl ester of coconut fatty acid | 80 | — | 10.2 | 3.5 | 18 | 0.4 | −7.5 |
| | 16 | Coconut oil/trimethylolpropane(0.5)/ethylene oxide(9) + Methyl ester of coconut fatty acid | 72 | — | 8.1 | 5.2 | 46 | 0.6 | −5.0 |
| | 17 | Palm kernel oil/glycerol(0.5)/ethylene oxide (13.5) + caprylic acid | 76 | — | 9.2 | 8.9 | 10 | 0.5 | −15.0 |
| | 18 | Palm kernel oil/glycerol(0.5)/ethylene oxide (13.5) + 2-ethylhexanoic acid | 68 | — | 10.1 | 9.5 | 13 | 0.6 | −15.0 |
| | 19 | Coconut oil/glycerol(0.5)/ethylene oxide(12) | — | 99 | 48.0 | 5.1 | 33 | 0.9 | −7.5 |
| | 20 | Coconut oil/ethylene glycol(0.45)/ethylene oxide · propylene oxide random**(15.5) | — | 85 | 9.1 | 3.4 | 35 | 0.2 | −24.0 |
| | 21 | Coconut oil/ethylene glycol(0.45)/ethylene oxide · propylene oxide block**(15. 5) | — | 82 | 9.2 | 7.0 | 62 | 0.6 | −27.0 |
| | 22 | Coconut oil/ethylene glycol(0.45)/ethylene oxide · propylene oxide random**(39) | — | 70 | 15.4 | 2.1 | 19 | 0.4 | −35.0 |
| | 23 | Coconut oil/glycerol(0.3)/ethylene oxide(7.5) | — | 99 | 8.2 | 5.7 | 54 | 0.5 | −2.5 |
| Comparative Example | 1 | Paraffin-type mineral oil | 22 | 30 | — | — | — | — | — |
| | 2 | Rapeseed oil | — | 99 | 35.0 | 118.3 | — | — | — |
| | 3 | Coconut oil/glycerol(0.3)/ethylene oxide(3.0) | — | — | 7.6 | 7.0 | 64 | 0.4 | 12.5 |
| | 4 | Rapeseed oil/glycerol(0.3)propylene oxide(3.0) | — | — | 8.5 | 155 | 45 | 0.6 | −25.0 |

*Ethylene oxide/Propylene oxide = 40 mol %/60 mol %

**Ethylene oxide/Propylene oxide = 20 mol %/80 mol %

Note: Units for the parameters in Table 1 are as follows: kinematic viscosity, $mm^2/s$: iodine value, Ig/100; hydroxyl value, mgKOH/g: and acid value, mgKOH/g.

Test Example 2

[Thermal Oxidation Stability Test]

According to the oxidation stability test of lubricating oil(JIS-K2514), a test was carried out at a temperature of 165.5° C. for 24 hours. The results are shown in Table 2.

As compared with rapeseed oil, all the lubricating base oils of the present examples show lower increases in total acid value and lower increasing rates of kinematic viscosity, exhibiting superior stability to thermal oxidation.

TABLE 2

| | | Increase in total acid value Post-test - Pre-test (mgKOH/g) | Increase rate of viscosity Post-test/ Pre-test × 100(%) |
|---|---|---|---|
| Examples | 1 | −0.3 | 99 |
| | 2 | 0.1 | 102 |
| | 3 | 1.0 | 138 |
| | 4 | 0.6 | 114 |
| | 5 | 0.1 | 101 |
| | 6 | 0.1 | 101 |
| | 7 | 0.0 | 99 |
| | 8 | 0.1 | 100 |
| | 9 | 0.4 | 104 |
| | 10 | 0.4 | 103 |
| | 11 | 0.3 | 102 |
| | 12 | 0.5 | 110 |
| | 13 | 0.2 | 102 |
| | 14 | 0.4 | 105 |
| | 15 | 0.6 | 110 |
| | 16 | 0.8 | 112 |
| | 17 | 1.0 | 116 |
| | 18 | 0.8 | 118 |
| | 19 | 0.2 | 102 |
| | 20 | 0.3 | 103 |
| Comparative Examples | 2 | 1.4 | 206 |
| | 4 | 1.2 | 182 |

Test Example 3

[Compatibility Test]

For the purpose of evaluating the compatibility of the biodegradable base oil obtained in the present invention, the compatibility of each of the oils with a mineral oil was evaluated by the following method. Specifically, each of the biodegradable base oils of the present invention and a mineral oil ("SUPER OIL A" manufactured by Nippon Oil Co., Ltd.) were placed in a 200 ml-mixing vessel in a total amount of biodegradable base oil and mineral oil of 100 g, so as to make a proportion of the biodegradable base oil in the mixture to be 10% by weight, 30% by weight, 50% by weight, or 90% by weight, respectively. The mixture was stir-blended at about 200 rpm for 10 minutes at a temperature of 60° C. Next, the mixture was transferred to a 100 ml-screw tube, and observation was made on the appearance after keeping the screw tube standing in a 60° C. thermostatic oven for 24 hours. The results are shown in Table 3.

TABLE 3

| | | Hydroxyl value (mgKOH/g) | 10% by weight | 30% by weight | 50% by weight | 90% by weight |
|---|---|---|---|---|---|---|
| Examples | 3 | 220 | Separated | Separated | Separated | Separated |
| | 6 | 120 | Separated | Separated | Separated | Separated |
| | 8 | 75 | Separated | Separated | Uniformly dissolved | Uniformly dissolved |
| | 4 | 48 | Separated | Uniformly dissolved | Uniformly dissolved | Uniformly dissolved |
| | 11 | 46 | Uniformly dissolved | Uniformly dissolved | Uniformly dissolved | Uniformly dissolved |
| | 15 | 18 | Uniformly dissolved | Uniformly dissolved | Uniformly dissolved | Uniformly dissolved |
| | 17 | 10 | Uniformly dissolved | Uniformly dissolved | Uniformly dissolved | Uniformly dissolved |

As is clear from Table 3, in an ethylene oxide adduct, lower the hydroxyl value became, more improved the compatibility between the biodegradable base oil and the mineral oil. Also, the compatibility of the propylene oxide adduct had a higher compatibility than that of the ethylene oxide adduct (Comparison between Examples 4 and 11).

Test Example 4

[Lubricity Test]

According to an ASTM-D-2783 testing method using a four-ball testing machine, the testing method usually used for lubricity evaluation tests of hydraulic oils, a test was conducted under the conditions of loads of 30 kgf and 60 kgf, a rotational speed of 1,200 rpm, and a testing time of 20 minutes. The wear scar diameter (mm) of each testing ball for each of the tested hydraulic oils are shown in Table 4.

TABLE 4

| Load | | 30 kgf | 60 kgf |
|---|---|---|---|
| Examples | 11 | 0.43 mm | 0.49 mm |
| | 19 | 0.48 | 0.65 |
| | 21 | 0.45 | 0.51 |
| Comparative Examples | 1 | 0.65 | 2.90 |
| | 2 | 0.51 | 0.88 |
| Comparative Example 1 + TCP* (0.5%) | | 0.50 | 0.85 |
| Comparative Example 2 + TCP* (0.5%) | | 0.46 | 0.69 |

*TCP (Tricresyl phosphate; manufactured by Daihachi kagaku)

As is clear from Table 4, the lubricating base oils of Examples showed highly superior lubricity than those of Comparative Examples. In addition, the lubricating base oils of Examples had equivalent or higher level of lubricity when compared with comparative lubricating oils added together with TCP, an anti-wear agent.

INDUSTRIAL APPLICABILITY

Since the lubricating base oils and the lubricating oil compositions of the present invention exhibit a high biodegradability and a high stability to thermal oxidation, they are suitably used in the field where biodegradability of lubricating oils are in demand in order to prevent environmental pollution.

We claim:

1. A biodegradable lubricating base oil obtained by the process comprising;

(a) carrying out in a reaction mixture an addition reaction of an alkylene oxide and a transesterification, using fats and oils, a polyhydric alcohol, and the alkylene oxide as starting materials to give a fats and oils derivative, wherein 5 to 150 mol of the alkylene oxide to 1 mol of the fats and oils is used and wherein iodine value of the fats and oils as starting materials is not more than 60 (Ig/100 g); and (b) esterifying all or a part of terminal hydroxyl groups of the fats and oils derivative with an aliphatic carboxylic acid or an ester derivative thereof.

2. A biodegradable lubricating base oil obtained by the process comprising;

(a) carrying out in a reaction mixture an addition reaction of an alkylene oxide and a transesterification, using fats and oils, an aliphatic carboxylic acid, and the alkylene oxide as starting materials to give a fats and oils derivative, wherein 5 to 150 mol of the alkylene oxide to 1 mol of the fats and oils is used and wherein iodine value of the fats and oils as starting materials is not more than 60 (Ig/100 g); and (b) esterifying all or a part of terminal hydroxyl groups of the fats and oils derivative with an aliphatic carboxylic acid or an ester derivative thereof.

3. The biodegradable lubricating base oil according to claim 2, which is obtained by using in step (a) at least one of the aliphatic carboxylic acids selected from the group consisting of (i) linear monocarboxylic acids having 1 to 12 carbon atoms, (ii) branched monocarboxylic acids having 4 to 20 carbon atoms, (iii) linear or branched dicarboxylic acids having 4 to 20 carbon atoms, and (iv) polycarboxylic acids obtainable by polymerization of unsaturated carboxylic acids having 3 to 18 carbon atoms.

4. The biodegradable lubricating base oil according to claim 1, which has an iodine value of not higher than 50 (Ig/100 g).

5. The biodegradable lubricating base oil according to claim 2, which has an iodine value of not higher than 50 (Ig/100 g).

6. The biodegradable lubricating base oil according to claim 1, which is obtained by using 9 to 90 mol of the alkylene oxide to 1 mol of the fats and oils, the alkylene oxide containing 40 to 100 mol % ethylene oxide and 0 to 60 mol % propylene oxide.

7. The biodegradable lubricating base oil according to claim 2, which is obtained by using 9 to 90 mol of the alkylene oxide to 1 mol of the fats and oils, the alkylene oxide containing 40 to 100 mol % ethylene oxide and 0 to 60 mol % propylene oxide.

8. The biodegradable lubricating base oil according to claim 1, which is obtained by using 5 to 30 mol of the alkylene oxide to 1 mol of the fats and oils, the alkylene oxide containing 0 to 40 mol % ethylene oxide and 60 to 100 mol % propylene oxide.

9. The biodegradable lubricating base oil according to claim 2, which is obtained by using 5 to 30 mol of the alkylene oxide to 1 mol of the fats and oils, the alkylene oxide containing 0 to 40 mol % ethylene oxide and 60 to 100 mol % propylene oxide.

10. The biodegradable lubricating base oil according to claim 1, containing a compound represented by the general formula (III):

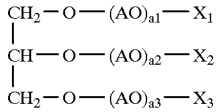

(III)

wherein AO represents an alkylene oxide; a1, a2, and a3 independently represent a numeral of 0 or a positive integer, a1+a2+a3 is from 5 to 150; $X_1$, $X_2$ and $X_3$ independently represent H or an R'CO group wherein R' is an alkyl group derived from the aliphatic carboxylic acid or the fats and oils, at least one of $X_1$, $X_2$ and $X_3$ is an R'CO group.

* * * * *